US008627629B2

(12) United States Patent
Tims

(10) Patent No.: US 8,627,629 B2
(45) Date of Patent: Jan. 14, 2014

(54) ASSEMBLY AND METHOD FOR A CONCRETE WALL

(71) Applicant: Mark Tims, Brackney, PA (US)

(72) Inventor: Mark Tims, Brackney, PA (US)

( * ) Notice: Subject to any disclaimer, the term of this patent is extended or adjusted under 35 U.S.C. 154(b) by 0 days.

(21) Appl. No.: 13/755,539

(22) Filed: Jan. 31, 2013

(65) Prior Publication Data

US 2013/0192156 A1 Aug. 1, 2013

Related U.S. Application Data

(60) Provisional application No. 61/592,927, filed on Jan. 31, 2012.

(51) Int. Cl.
*E04B 2/86* (2006.01)

(52) U.S. Cl.
USPC ..... 52/426; 52/405.1

(58) Field of Classification Search
USPC ..... 52/403.1–403.4, 424, 426, 428, 432
See application file for complete search history.

(56) References Cited

U.S. PATENT DOCUMENTS

| | | | | |
|---|---|---|---|---|
| 5,987,830 | A | 11/1999 | Worley | |
| 6,698,710 | B1 * | 3/2004 | VanderWerf | 249/216 |
| 7,059,577 | B1 * | 6/2006 | Burgett | 249/40 |
| 7,415,804 | B2 * | 8/2008 | Coombs et al. | 52/426 |
| 2001/0000844 | A1 * | 5/2001 | Kubica | 52/427 |
| 2003/0005659 | A1 * | 1/2003 | Moore, Jr. | 52/473 |
| 2008/0005991 | A1 * | 1/2008 | Meilleur et al. | 52/426 |
| 2011/0131911 | A1 * | 6/2011 | McDonagh | 52/426 |

* cited by examiner

*Primary Examiner* — William Gilbert
*Assistant Examiner* — Alp Akbasli
(74) *Attorney, Agent, or Firm* — Panitch Schwarze Belisario & Nadel LLP

(57) ABSTRACT

An assembly for constructing a concrete wall includes a first plurality of form panels defining a first wall plane, a second plurality of form panels defining a second wall plane and a first plurality of foam sheets. The first and second plurality of form panels are constructed of frames and webs. The webs are constructed of a web material. The first plurality of foam sheets define a first concrete interface plane. The first concrete interface plane is generally parallel to the first and second wall planes. The first plurality of foam sheets is secured to the first plurality of form panels by a screw. The first plurality of form panels, second plurality of form panels and first plurality of foam sheets are secured by a plurality of ties. The first concrete interface plane and the second wall plane define a wall cavity.

10 Claims, 7 Drawing Sheets

ASSEMBLY AND METHOD FOR A CONCRETE WALL

CROSS-REFERENCE TO RELATED APPLICATIONS

The present application claims the benefit of U.S. Provisional Patent Application No. 61/592,927, filed on Jan. 31, 2012, entitled "Assembly and Method for a Concrete Wall," the entire contents of which is incorporated herein by reference in its entirety

BACKGROUND OF THE INVENTION

Concrete walls typically are constructed by excavating a site, pouring footers, assembling concrete forms in the outline of the wall, pouring concrete into the forms, allowing the poured concrete to cure, disassembling or stripping the forms from the cured concrete wall, framing the wall, insulating the wall and applying drywall to the inner surface of the wall. The process can be time consuming and includes numerous steps. It would be desirable to develop an assembly and method for constructing a concrete wall that eliminates certain of the steps and simplifies the construction process without sacrificing quality and/or strength of the wall.

A method and material has been developed to eliminate forms and reduce the number of steps required to construct a concrete wall. The assembly and method includes a prefabricated foam material that is used in place of the concrete forms. In this assembly and method, concrete is poured directly into the foam material that is assembled in the fashion of forms. At the conclusion of pouring the concrete, the foam material is not stripped from the wall, as the foam material is used as permanent insulation. In addition, the foam material becomes integrated with the concrete as the concrete interdigitates or partially flows into and cures within a surface layer of the foam, to mechanically secure the foam to the concrete. Further, the foam material can include pre-engaged strips that are configured to accept fasteners for mounting drywall panels to the foam material to finish an internal surface of the wall. However, pouring heavy concrete into foam material can cause instability in the assembled foam material, which typically does not occur with concrete forms. The instability may result in defects in the wall that may cause failure of the wall in worst-case scenarios. It would be desirable to develop a method for constructing a concrete wall that reduces the steps of the process by utilizing the foam material, without sacrificing stability of the wall during the concrete pouring process.

BRIEF SUMMARY OF THE INVENTION

An assembly for constructing a concrete wall includes a first plurality of form panels defining a first wall plane, a second plurality of form panels defining a second wall plane and a first plurality of foam sheet positioned adjacent the first plurality of form panels. The first and second wall planes are positioned generally parallel to each other. The first and second plurality of form panels are constructed of rigid frames and webs that define the first and second wall planes. The webs are constructed of a web material capable of being penetrated by screws. The first plurality of foam sheets define a first concrete interface plane. The first concrete interface plane is generally parallel to the first and second wall planes. The first plurality of foam sheets is secured to the first plurality of form panels by at least one of the screws. The first plurality of form panels, second plurality of form panels and first plurality of foam sheets are secured to each other by a plurality of ties. The first concrete interface plane and the second wall plane at least partially define a wall cavity.

A method for constructing a concrete wall having an insulating layer secured thereto utilizing a first plurality of form panels, a second plurality of form panels and a first plurality of foam sheets includes the steps of assembling the first plurality of form panels to define a first wall plane, mounting a plurality of ties along first panel interfaces of the first plurality of form panels, assembling a first plurality of foam sheets adjacent the first wall plane, assembling a plurality of support rods proximate the first plurality of foam sheets on a side of the first plurality of foam sheets opposite the first wall plane, assembling a second plurality of form panels proximate the support rods, securing the first plurality of foam sheets to the first plurality of form panels with a plurality of screws extending through webs in the first plurality of form panels, pouring uncured concrete into the wall cavity, waiting a predetermined time to allow the uncured concrete to cure, removing the first and second plurality of form panels from the concrete wall, thereby exposing an insulated composite wall. The first plurality of foam sheets being notched to accommodate the plurality of ties. The second plurality of form panels assembled such that the ties extend through second panel interfaces of the second plurality of form panels. The plurality of ties secure the first and second plurality of form panels and the first plurality of foam sheets relative to each other. The first plurality of foam sheets define a first concrete interface plane and the second plurality of form panels define a second wall plane. The first concrete interface plane and the second wall plane at least partially define a wall cavity.

BRIEF DESCRIPTION OF THE DRAWINGS

The foregoing summary, as well as the following detailed description of the preferred invention, will be better understood when read in conjunction with the appended drawings. For the purpose of illustrating the preferred embodiments of the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
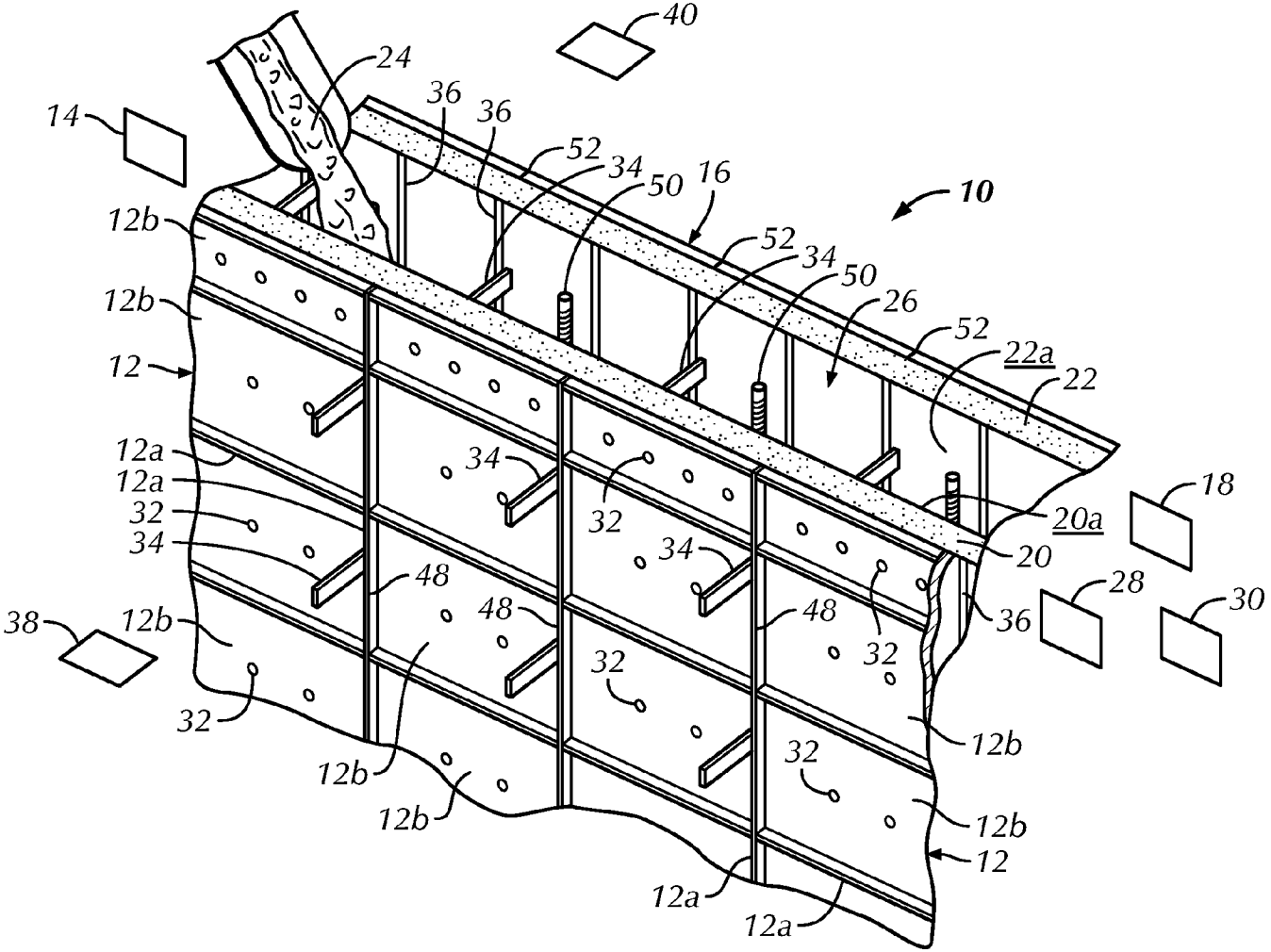
FIG. 1 is a front perspective, fragmentary view of an assembly for constructing a concrete wall in accordance with a first preferred embodiment of the present invention.

Certain terminology is used in the following description for convenience only and is not limiting. The words "right," "left," "lower," and "upper" designate directions in the drawings to which reference is made. The words "inwardly" or "distally" and "outwardly" or "proximally" refer to directions toward and away from, respectively, the geometric center or orientation of the device and instruments and related parts thereof. Unless specifically set forth herein, the terms "a", "an" and "the" are not limited to one element but instead should be read as meaning "at least one". The terminology includes the above-listed words, derivatives thereof and words of similar import.

Referring to FIGS. 1-9, the present application is directed to preferred assemblies, generally designated 10, 10', 10", 10''', and methods for constructing a concrete wall. In the first preferred embodiment, the assembly 10 includes a first plurality of form panels or forms 12 defining a first wall plane 14, a second plurality of form panels 16 defining a second wall plane 18, a first plurality of foam sheets 20 positioned adjacent the first plurality of form panels 12 and a second plurality of foam sheets 22 positioned adjacent the second plurality of form panels 16. The components are assembled, as shown in FIG. 1, such that concrete 24 is poured into a wall cavity 26 defined between a first concrete interface plane 28 and a second concrete interface plane 30 at the facing surfaces 20*a*, 22*a* of the first and second plurality of foam sheets 20, 22, respectively, in the first preferred embodiment, to form the concrete wall. Like reference numerals are utilized to identify like elements and/or components of the first, second, third and fourth assemblies 10, 10', 10", 10''', of the first, second, third and fourth preferred embodiments throughout, with a prime symbol (') utilized to identify the elements of the second preferred embodiment, a double prime symbol (") to identify the elements of the third preferred embodiment and a triple prime symbol (''') to identify the elements of the fourth preferred embodiment.

Referring to FIG. 1, in the first preferred embodiment, the first and second concrete interface planes 28, 30 are defined by the facing surfaces 20*a*, 22*a* of the first and second plurality of foam sheets 20, 22. The first and second concrete interface planes 28, 30 and the facing surfaces 20*a*, 22*a* are preferably generally parallel in the first preferred embodiment, but are not so limited. The first and second concrete interface planes 28, 30 and the facing surfaces 20*a*, 22*a* may be curved, textured, angled or otherwise configured for ornamental, structural or general design purposes.

The first and second plurality of form panels 12, 14 are constructed of rigid frames 12*a* that extend generally vertically and horizontally and webs 12*b* that extend between the frames 12*a*. The frames 12*a* are preferably constructed of metallic members that are welded or otherwise joined together and the webs 12*b* are preferably constructed of wood that are joined to the frames 12*a*. The frames 12*a* preferably provide rigidity and strength to the first and second plurality of form panels 12, 14 and the webs 12*b* generally define the first and second wall planes 14, 16. The first and second plurality of form panels 12, 14 are not limited to constructions utilizing metallic rigid frames 12*a* and wooden webs 12*b*, but such materials and constructions are preferred to provide rigidity and strength, as well as to maintain the weight of each of the plurality of form panels 12, 14 at a reasonable level to permit movement of the components for assembly and breakdown or stripping of the wall. However, the first and second plurality of form panels 12, 14 are not limited to such constructions and may be constructed of completely metallic constructions, composite constructions, or alternative constructions, as long as the constructions are able to take on the general size and shape of the first and second plurality of form panels 12, 14, withstand the normal operating conditions of the form panels 12, 14 and perform the function of the plurality of form panels 12, 14 of defining the wall cavity 26 that ultimately defines the size and shape of the concrete wall.

In the first preferred embodiment, the webs 12*b* are constructed of the wooden material such that they are capable of being penetrated by screws 32 to secure the first and second plurality of foam sheets 20, 22 to the first and second plurality of form panels 12, 14, respectively. There are preferably more screws 32 secured near the top of the plurality of form panels 12, 14 to tightly secure the upper end of the first and second plurality of foam sheets 20, 22 to the first and second plurality of form panels 12, 14 in the assembled configuration to limit the possibility that uncured concrete 24 flows along the first and second wall planes 14, 18 between the first and second plurality of form panels 12, 14 and the first and second plurality of foam sheets 20, 22, respectively. However, the number and type of screws or fasteners 32 are not limiting and the screws and/or fasteners 32 are configured and arranged to secure the first and second plurality of form panels 12, 14 and the first and second plurality of foam sheets 20, 22 in the assembled configuration and such that the first and second plurality of form panels 12, 14 can be disengaged or stripped from the first and second plurality of foam sheets 20, 22 when the concrete wall is cured. In the first preferred embodiment, the screws 32 are comprised of two inch (2") sheet rock screws 32 that penetrate the wooden webs 12*b*, draw the first and second plurality of foam sheets 20, 22 into generally facing engagement with the first and second plurality of form panels 12, 14 and are disengageable from the webs 12*b* to permit stripping of the cured wall. The screws 32 are not limited to two inch (2") sheet rock screws 32 an may be comprised of nearly any variety of fastener, clamp or securing mechanism that are able to perform the function of the screws 32 and withstand the normal operating conditions of the screws 32.

The first and second plurality of form panels 12, 14 generally provide stability to the assembly, while the first and second foam sheets 20, 22 provide some stability, but generally are utilized as insulation for the cured wall. In addition, the first and second foam sheets 20, 22 define the first and second concrete interfaces 28, 30 that define at least portions of the wall cavity 26 in the first preferred embodiment. The uncured concrete 24 preferably infiltrates or interdigitates at least partially into the surfaces of the first and second plurality of foam sheets 20, 22 to integrate the concrete 24 with the first and second foam sheets 20, 22 when the concrete 24 is poured and, ultimately, when the wall cures. Accordingly, in the cured configuration, the first and second foam sheets 20, 22 are secured and integrated into the cured concrete wall to provide insulation and a material to directly secure drywall or other finishing material to the wall, as is described in greater detail below.

In the assembled configuration of the first preferred embodiment, the first plurality of form panels 12, the second plurality of form panels 16, the first plurality of foam sheets 20 and the second plurality of foam sheets 22 are secured to each other and stabilized by a plurality of ties 34. The plurality of ties 34 generally provide stability in a lateral direction, generally perpendicular to the first and second wall planes 14, 18 and first and second concrete interface planes 28, 30 and assist in maintaining the first and second wall planes 14, 18 and first and second concrete interface planes 28, 30 relatively parallel to each other during assembly, pouring of the concrete 24, curing of the concrete 24 and stripping of the wall. In the first, third and fourth preferred embodiments, the plurality of ties 34 are comprised of flat ties or loop ties and are generally constructed of a metallic material. However, the plurality of ties 34 are not limited to flat or loop ties and may be comprised of nearly any structure or mechanism that assists in securing the first plurality of form panels 12, the second plurality of form panels 16, the first plurality of foam sheets 20 and the second plurality of foam sheets 22 to each other in the assembled configuration of the first preferred embodiment. In addition, the plurality of ties 34 are not limited to constructions of metallic materials and may be constructed of nearly any material that is generally strong and stiff, is able to perform the typical function of the plurality of ties 34 and withstand the normal operating conditions of the plurality of ties 34. Further, in the first, third and fourth preferred embodiments, each of the plurality of ties 34 are breakable at or near the first and second concrete interface planes 28, 30 before, during or after stripping of the first and second plurality of form panels 12, 14 from the cured wall. Accordingly, at least the central portions of the plurality of ties 34 are preferably configured to be maintained within the cured wall during the life of the wall. Therefore, the ties 34 are preferably resistant to wear and corrosion from uncured and cured concrete 24 and any materials that may be utilized in the concrete 24 or on the wall.

In the first preferred embodiment, the wall cavity 26 is at least partially defined by the first and second plurality of foam sheets 20, 22, particularly at the first and second concrete interface planes 28, 30. The first and second foam sheets 20, 22 of the first preferred embodiment are retained with the cured concrete wall following stripping of the first and second plurality of form panels 12, 16 and provide insulation to the finished wall. In addition, the first and second foam sheets 20, 22 provide a surface for mounting drywall at the first and second wall planes 14, 18 of the first preferred embodiment. Accordingly, the assembly of the first preferred embodiment may be employed for internal walls of a structure wherein drywall may be secured to both sides of the wall following curing and stripping of the wall. However, the assembly of the first preferred embodiment is not limited to comprising internal walls and may be comprised of external walls or nearly any concrete structure wherein mounting of the first and second plurality of foam sheets 20, 22 to the sides of the wall when the wall is poured is desirable to the designer and/or consumer. In addition, the concrete 24 preferably interdigitates with the first and second plurality of foam sheets 20, 22 at the first and second concrete interface planes 28, 30 to further laterally secure the first and second plurality of foam sheets 20, 22 to the wall.

In the first preferred embodiment, the first plurality of foam sheets 20 includes spacer ties 36 incorporated into the first plurality of foam sheets 20. The spacer ties 36 are located at the first wall plane 14 defined by the first plurality of foam sheets 20. The first wall plane 14 is generally parallel to and spaced from the first concrete interface plane 28. The spacer ties 36 extend generally vertically along the first wall plane 14 and are utilized as a mounting line for dry wall sheets (not shown) or other wall covering to finish the concrete wall. Accordingly, the stripped wall can be quickly mounted with dry wall sheets to finish the wall, without the additional step of framing a wall at the wall interface. In addition, the concrete wall includes the first plurality of foam sheets 20 and the second plurality of foam sheets 22 to provide insulation for the wall. The first and second plurality of form panels 12, 16 are utilized to provide stability to the wall during pouring, stripping and curing of the wall, thereby preventing and/or limiting blowout, warping, shifting, arching or otherwise deforming of the wall during pouring, stripping and curing of the wall.

The first and second plurality of form panels 12, 16 and the first and second plurality of foam sheets 20, 22 define a bottom plane 38 and a top plane 40 in the first preferred embodiment. The bottom and top planes 38, 40 along with the first concrete interface plane 28 and the second concrete interface plane 30 at least partially define the wall cavity 26 in the first preferred embodiment. The uncured concrete 24 is poured into the wall cavity 26 in the first preferred embodiment to define the concrete wall and adheres to or interdigitates with the first and second plurality of foam sheets 20, 22 to secure the cured concrete to the foam sheets 20, 22 and define the final insulated wall. Such a construction is generally stable during pouring, curing and stripping as a result of the strength and stiffness provided by the first and second plurality of form panels 12, 14, first and second foam sheets 20, 22 and plurality of ties 34 of the first preferred embodiment. In addition, this construction results in foam on both sides of the cured wall resulting in generally significant insulation properties for the wall.

Figure 2:
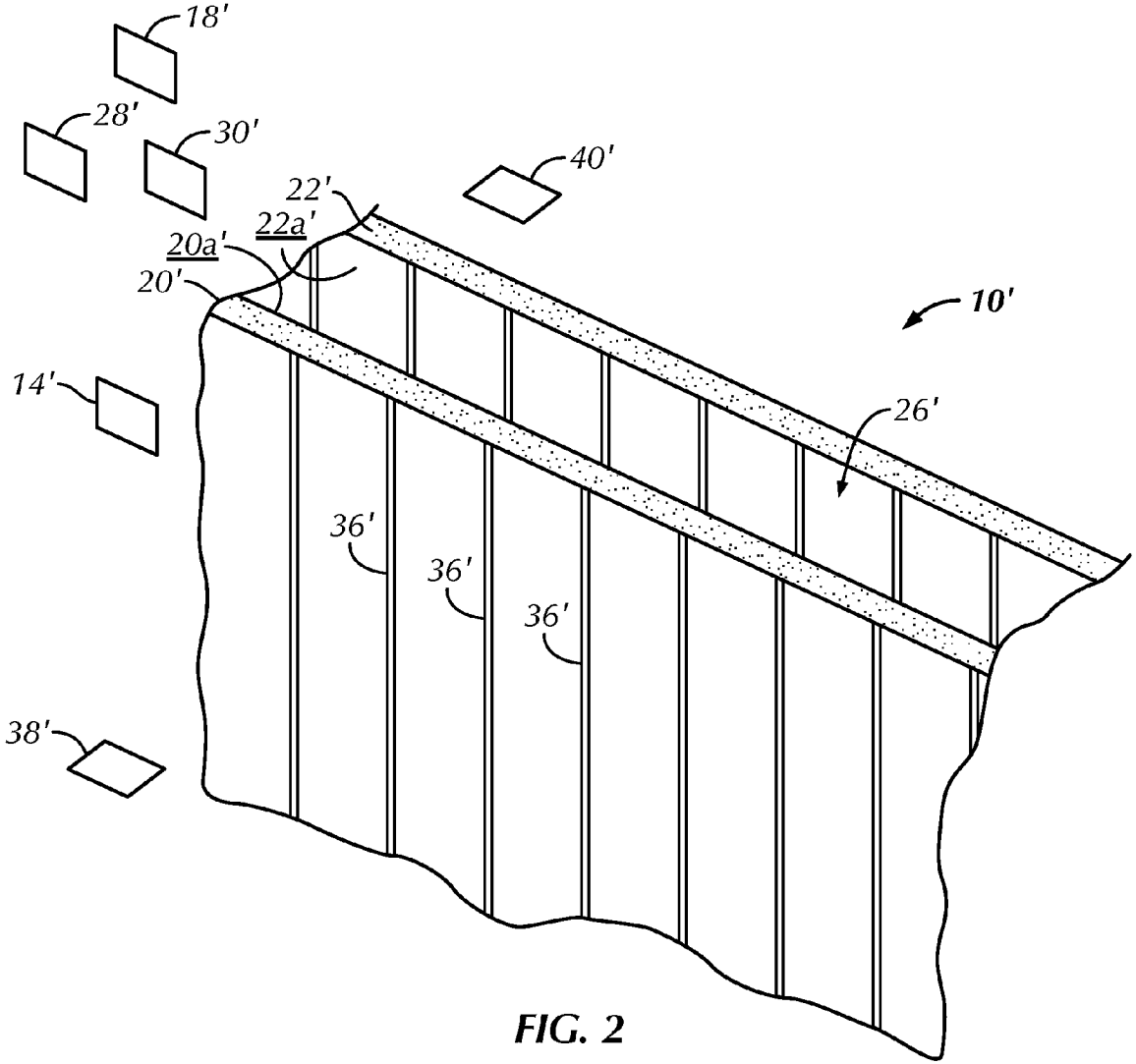
FIG. 2 are front perspective, fragmentary view of an assembly for constructing a concrete wall in accordance with a second preferred embodiment of the present invention.
Figure 3:
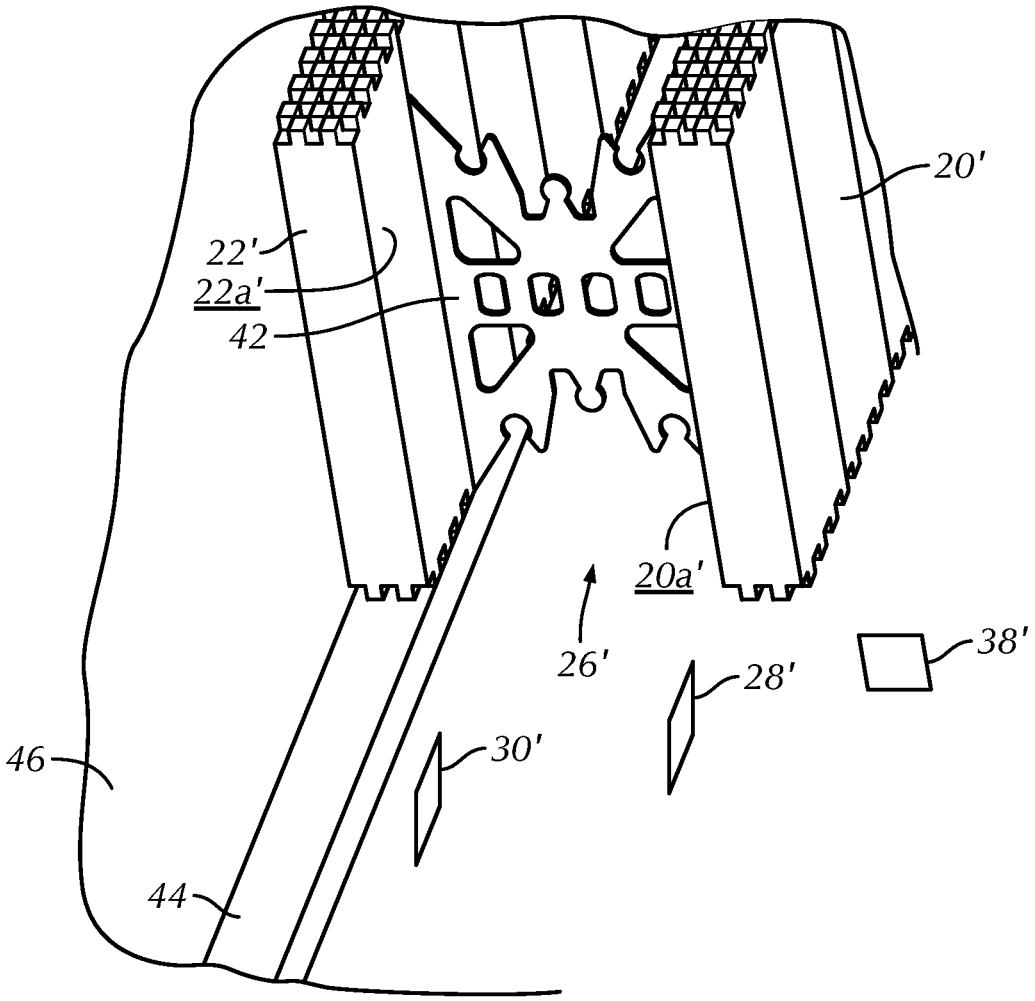
FIG. 3 is a side perspective, partially assembled view of the assembly of FIG. 2.

Referring to FIGS. 2 and 3, in the second preferred embodiment, the wall is formed by an assembly of the first and second plurality of foam sheets 20', 22' without the first and second plurality of form panels 12, 14 to support the first and second plurality of foam sheets 20', 22'. The first and second plurality of foam sheets 20', 22' are preferably supported in the second preferred embodiment by wall webs 42 and a base support 44, both of which support the first and second plurality of foam sheets 20', 22' to limit shifting of the assembly of the second preferred embodiment during pouring, curing, stripping and use. The wall webs 42 are preferably mounted to and between the first and second plurality of foam sheets 20', 22' to provide strength and stiffness to the assembled first and second plurality of foam sheets 20', 22' thereby limiting and/or preventing blowout, warping, shifting or other moving of the foam sheets 20', 22' and the wall. In addition, the first and second plurality of foam sheets 20', 22' are further preferably stabilized by securing one or both of the first and second plurality of foam sheets 20', 22' to a floor or footer 46 using the base support 44. In the second preferred embodiment, the base support 44 is comprised of a L-shaped or U-shaped channel that is fixed to the floor or footer 46 and receives the bottom of at least one or both of the first and second plurality of foam sheets 20', 22' to stabilize the assembly during assembly, pouring, curing, stripping and/or general use. The base support 46 and wall webs 44 are also preferably maintained in the final finished wall.

Figure 4:
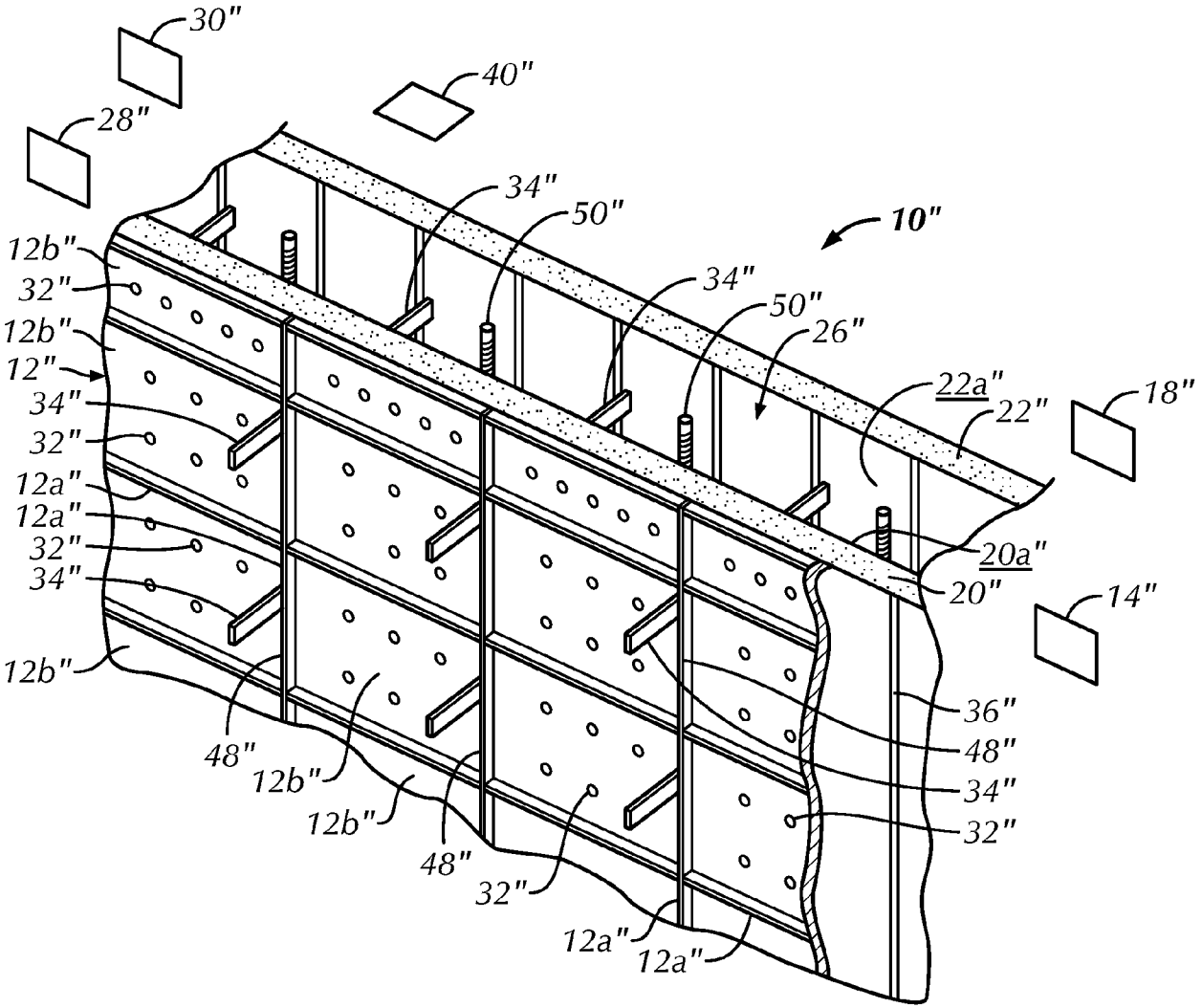
FIG. 4 is a front perspective, fragmentary view of an assembly for constructing a concrete wall in accordance with a third preferred embodiment of the present invention.

Referring to FIG. 4, in the third preferred embodiment, the wall is constructed utilizing the first and second plurality of foam sheets 20", 22", the first plurality of form panels 16" and the plurality of ties 34". The finished wall of the third preferred embodiment includes the stability provided by the first plurality of form panels 16" during assembly and pouring of the uncured concrete 24 to prevent and/or limit blowout, shifting, moving, warping or otherwise moving of the wall. The first and second plurality of foam sheets 20", 22" also provide significant insulation to the wall and permit direct attachment of the dry wall to the spacer ties 36" following stripping of the first plurality of form panels 16" from the wall. In the third preferred embodiment, the finished wall includes the plurality of foam sheets 20", 22" on both sides, which generally provides significant insulation properties to the wall.

Figure 5:
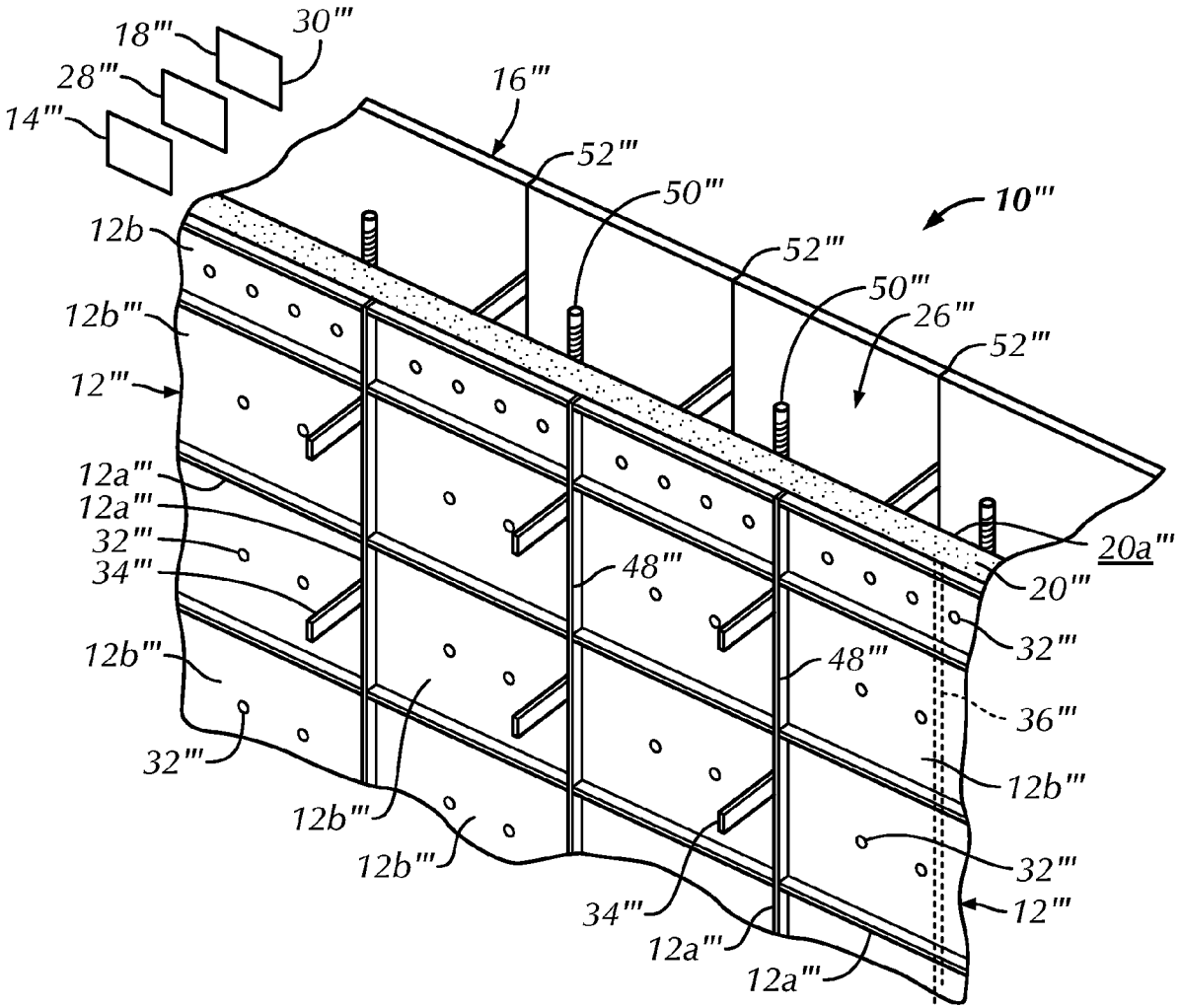
FIG. 5 is a front perspective, fragmentary view of an assembly for constructing a concrete wall in accordance with a fourth preferred embodiment of the present invention.

Referring to FIG. 5, in the fourth preferred embodiment, the wall is formed by the assembly of the first and second plurality of form panels 12''', 16''' and the first plurality of foam sheets 20'''. The first and second plurality of form panels 12''', 16''' provide significant strength and stiffness to the wall during assembly, pouring, curing and stripping, while the first plurality of foam sheets 20''' provide significant insulation and the ability to secure dry wall directly to the wall to efficiently finish the wall. In the fourth preferred embodiment, the side of the finished wall with the first plurality of foam sheets 20''' secured thereto is preferably in internal wall of the building for finishing, such as by drywall, and the opposite side is preferably an external wall.

Referring to FIGS. 1-9, in operation, the assemblies of the first, second, third and fourth preferred embodiments are utilized to construct a concrete wall having at least the first plurality of foam sheets 20, 20', 20", 20''' integrally mounted or interdigitated with the cured concrete 24 to provide insulation and a surface for mounting drywall or other finishing materials to the wall immediately after curing of the wall or stripping of the wall, if necessary. In the first, third and fourth preferred embodiments, the first plurality of form panels 12, 12", 12''' are assembled to define the first wall plane 14, 14", 14'''. The first plurality of form panels 12, 12', 12", 12''' are preferably assembled on a solid, planar surface, most preferably a concrete footer or floor 46 to limit settling and general movement of the wall during assembly, pouring, curing, stripping and the typically lifetime and normal operating conditions of the wall. However, the wall is not limited to being assembled on a footer or concrete floor 46 and may be formed on nearly any surface, preferably a planar surface, desired by a user and/or designer. The plurality of ties 34, 34", 34''' are mounted along first panel interfaces 48, 48", 48''' of the first plurality of form panels 16, 16", 16''' to secure and align the first plurality of form panels 12, 12", 12''' to the first plurality of foam sheets 20, 20', 20", 20''' and/or the second plurality of form panels 16, 16''' and/or the second plurality of foam sheets 22, 22', 22", depending upon which embodiment is being assembled. The first plurality of foam sheets 20, 20', 20", 20''' is subsequently assembled adjacent the first wall plane 14 by interlocking the individual foam sheets of the first plurality of foam sheets 20, 20', 20", 20'''. If the ties 34 are being used, the first plurality of foam sheets 20, 20', 20", 20''' are notched to accommodate the plurality of ties 34, 34", 34'''.

In the first, third and fourth preferred embodiments, a plurality of support rods 50, 50", 50''' are assembled proximate the first plurality of foam sheets 20, 20", 20''' on a side of the first plurality of foam sheets 20, 20", 20''' opposite the first wall plane 14, 14", 14'''. In the first and third preferred embodiments, the second plurality of form panels 22, 22" are assembled proximate the support rods 50, 50" and in the first preferred embodiment, the second plurality of form panels 16 are assembled such that the ties 34 extend through second panel interfaces 52 of the second plurality of form panels 16. The plurality of ties 34, 34''' secure the first and second plurality of form panels 12, 12''', 16, 16''' and the first plurality of foam sheets 20, 20''' relative to each other in the first and fourth preferred embodiments. The first plurality of foam sheets 20, 20", 20''' are preferably secured to the first plurality of form panels 12, 12", 12''' with a plurality of screws 32, 32", 32''' extending through the webs 12*b*, 12*b*", 12*b*''' in the first plurality of form panels 12, 12", 12'''. The first plurality of foam sheets 20, 20', 20", 20''' of each of the four preferred embodiments define the first concrete interface plane 28, 28', 28", 28'''. In the first and third preferred embodiments the second plurality of form panels 16, 16''' define a second wall plane 18, 18". The wall cavity 26, 26', 26", 26''' of the first through fourth preferred embodiments is defined at least partially by the first and second concrete interface planes 28, 28', 28", 28''', 30, 30', 30", 30''', which is where the uncured concrete 24 is poured to form the wall. Once poured, the concrete 24 is allowed to cure for a predetermined amount of time, thereby defining a concrete wall with at least the first plurality of foam panels 20, 20', 20", 20''' integrated therein. While the first and second foam sheets 20, 20', 20", 20''', 22, 22', 22" are maintained on or in the wall after curing, the first and/or second plurality of form panels 12, 12", 12''', 16, 16''' are removed or stripped from the wall, thereby exposing the insulated composite wall.

Referring to FIG. 1, in the first preferred embodiment, the first and second plurality of form panels 12, 16 and foam sheets 20, 22 are assembled with the plurality of ties 34 and plurality of support rods 50. The first and second plurality of form panels 12, 16 are tightly secured to the first and second plurality of foam sheets 20, 22, respectively, by the screws 32, preferably with additional screws near the top plane 40 to limit the chances the concrete 24 flows between the first plurality of form panels and sheets 12, 20 and second plurality of form panels and sheets 16, 22, respectively. At the conclusion of curing, the first and second plurality of form panels 12, 16 are stripped from the first and second plurality of foam sheets 20, 22, respectively, leaving the first and second plurality of foam sheets 20, 22 secured to opposite sides of the wall and providing significant insulation to both sides of the wall. In addition, when the first and second plurality of form panels 12, 16 are stripped from the wall, drywall may be immediately secured to both sides of the wall utilizing the spacer ties 36 that are integrated into the first and second plurality of foam sheets 20, 22. In addition, the plurality of support rods 50 provide strength and stiffness to the finished wall.

Referring to FIGS. 2 and 3, in the second preferred embodiment, the assembly 10' is defined by the first and second plurality of foam sheets 20', 22' secured together by a plurality of the wall webs 42, but without the benefit of the strength and stiffness of either of the pluralities of form panels 12, 16. To properly position the wall and provide stiffness and strength, at least proximate the bottom plane 38' of the wall, the base support 44 is secured to the ground below the wall to support the first and second plurality of foam sheets 20', 22'. The base support 44 is comprised of a steel U-shaped channel or L-shaped angle in the second preferred embodiment that receives the first plurality of foam sheets 20' therein and is maintained in the wall following curing. The base support 44 is not limited to steel U-shaped channels and may be comprised of nearly any element or component that is able to engage the first and/or second plurality of foam sheets 20', 22' to provide strength and stiffness to the first and/or second plurality of foam sheets 20', 22', particularly during assembly and pouring of the wall, such as an L-shaped bracket, fasteners, adhesive bonding or other component or element. In addition, the base support 44 is not limited to being secured exclusively to the first plurality of foam sheets 20', but may be secured to both the first and second plurality of foam sheets 20', 22' or between the sheets 20', 22'. The drywall may be secured to both sides of the wall directly to the first and second plurality of foam sheets 20', 22' following curing.

In the third preferred embodiment, referring to FIG. 4, the assembly 10" is comprised of the first and second plurality of foam sheets 20", 22", the first plurality of form panels 12", the ties 34", the plurality of support rods 50" and the screws 32" to secure the first plurality of form panels 12" to the first plurality of foam sheets 20". The first plurality of form panels 12" provide significant strength and stiffness to the assembly 10" during construction, pouring and curing, while providing the advantage of requiring only the first plurality of form panels 12" to be stripped from the cured wall, permitting quick mounting of drywall to the wall and providing significant insulation to the wall.

In the fourth preferred embodiment, referring to FIG. 5, the assembly 10''' is comprised of the first and second plurality of form panels 12''', 16''', first plurality of foam sheets 20''', ties 34''', plurality of support rods 50''' and screws 32'''. The first and second plurality of form panels 12''', 16''' provide significant strength and stiffness during assembly, pouring and curing, while the first plurality of foam sheets 20''' provides significant insulation to the cured wall and permits installation of drywall directly to the spacer ties 36''' following stripping of the first plurality of form panels 12'''. The first plurality of foam sheets 20''' are preferably mounted to an inside of the wall such that the drywall may be assembled to the first plurality of foam sheets 20''', while the outer side of the wall may be left exposed and fill material may be positioned next to the outer side of the wall, particularly in a basement wall. In addition, the fourth preferred embodiment is not necessarily limited in insulating capacity in comparison to the walls of the first, second or third preferred embodiments with the plurality of foam sheets on both sides of the wall, as the first plurality of foam sheets 20''' may be sized and configured to provide as much insulating capacity as the first, second and third embodiments, as will be apparent to one having ordinary skill in the art based on the present disclosure.

Figure 6:
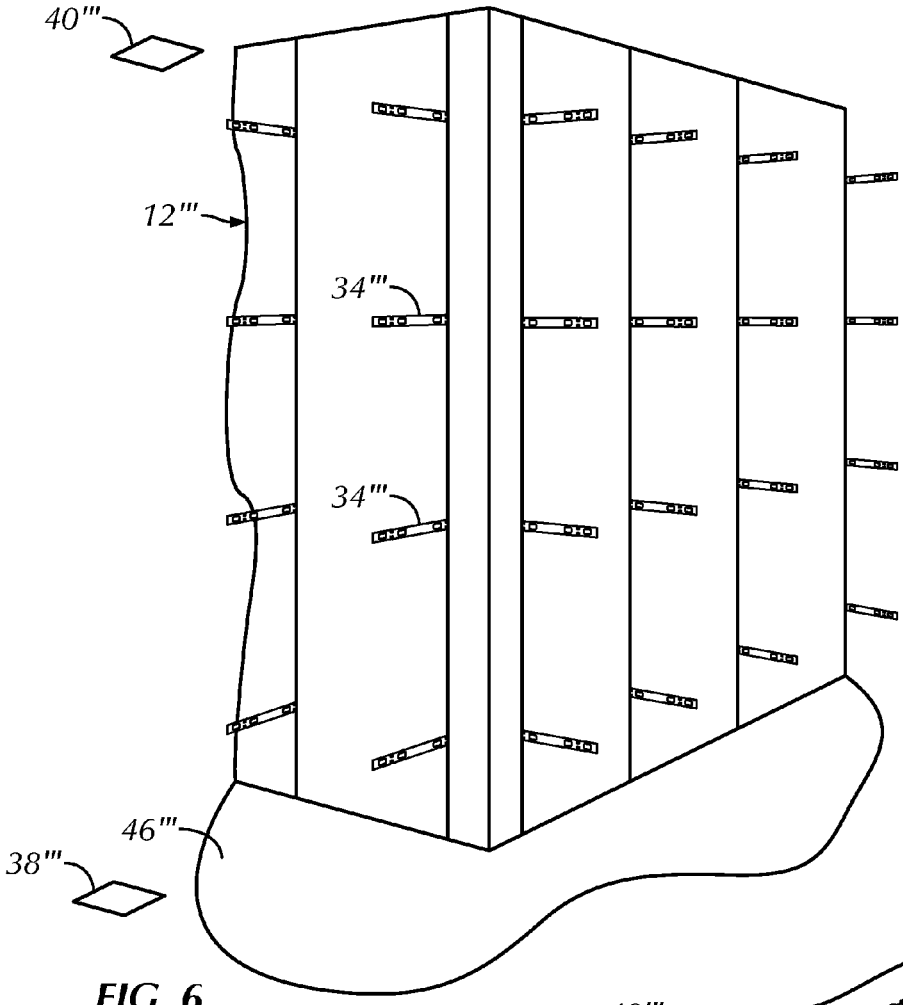
FIG. 6 is a front perspective view of an initial stage in the construction of the assemblies of the first, third and fourth preferred embodiments of FIGS. 1, 4 and 5.
Figure 7:
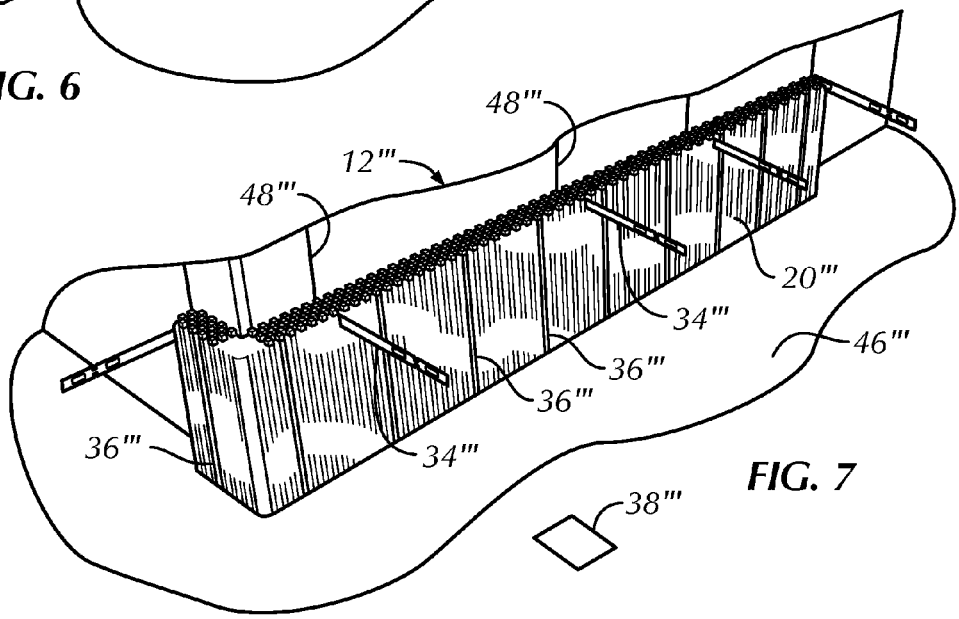
FIG. 7 is a front perspective, fragmentary, magnified view of another stage in the construction of the assemblies of the first, third and fourth preferred embodiments of FIGS. 1, 4 and 5.
Figure 8:
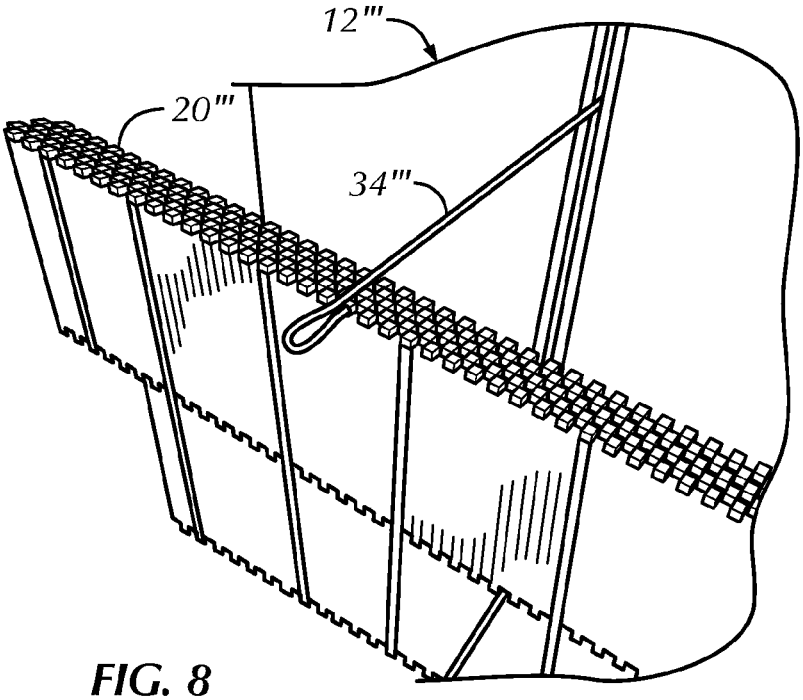
FIG. 8 is a top perspective, fragmentary, magnified view of the construction stage of FIG. 7, taken at a different location on the assembly.
Figure 9:
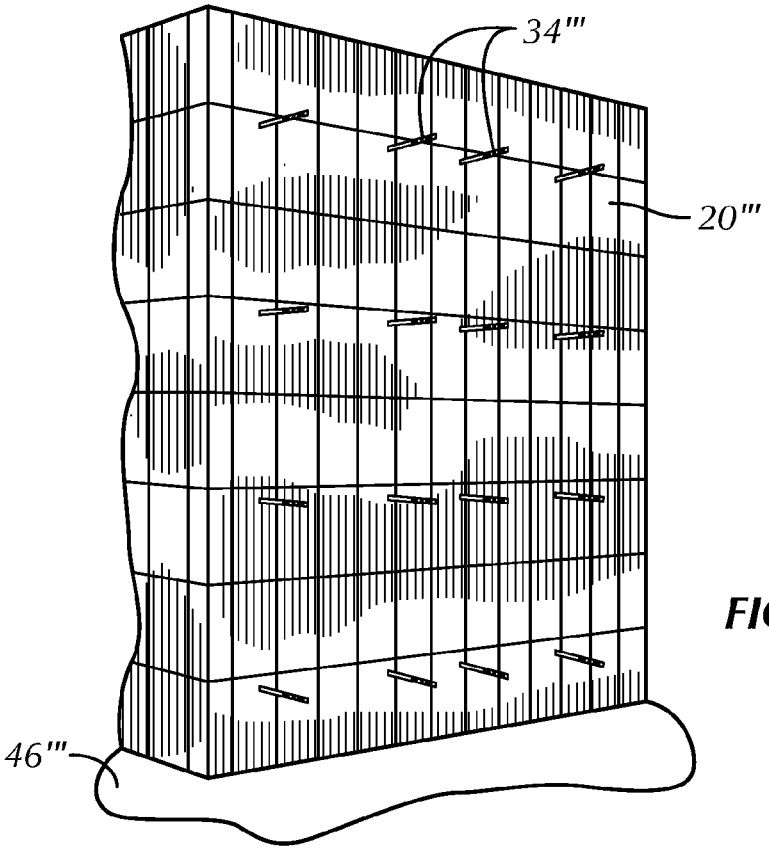
FIG. 9 is a front perspective, fragmentary view of the construction stage of FIG. 7, wherein a plurality of foam sheets are fully assembled against a first plurality of form panels in accordance with the assemblies of the first, third and fourth preferred embodiments of FIGS. 1, 4 and 5.

Referring to FIGS. 6 and 7, to construct the first, third and fifth preferred assemblies 10, 10", 10''', the first plurality of form panels 12, 12", 12''' are assembled, generally in the shape of the final cured wall with the flat and/or loop ties 34, 34", 34''' extending therefrom at generally regular intervals. The first plurality of foam sheets 20, 20", 20''' are then assembled in rows adjacent the first plurality of form panels 12, 12", 12'''. Each of the first plurality of foam sheets 20, 20", 20''' preferably includes digits or locking mechanisms on top and bottom surfaces that are able to interlock with successive upper or lower rows of the first plurality of foam sheets 20, 20", 20''' until the first plurality of foam sheets 20, 20", 20''' cover the first plurality of form panels 12, 12", 12''' between the bottom plane 38, 38", 38''' and a top plane 40, 40", 40'''. The first plurality of foam sheets 20, 20", 20''' are not limited to including the digits for interlocking with adjacent upper and lower rows of the first plurality of foam sheets 20, 20", 20''' and may be comprised of a single sheet of material or may have alternative mechanisms that secure one row of the first plurality of foam sheets 20, 20", 20''' to the adjacent row, such as fasteners, adhesive bonding, clamping or alternative securing mechanisms and/or methods. In addition, the second plurality of foam sheets 22, 22", 22''' has a similar construction and assembly method, but is not so limited.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An assembly for constructing a concrete wall, the assembly comprising:

a first plurality of form panels defining a first wall plane;

a second plurality of form panels defining a second wall plane, the first and second wall planes being generally parallel to each other, the first and second plurality of form panels being constructed of rigid frames and webs that define the first and second wall planes, respectively, the webs constructed of a web material capable of being penetrated by screws; and a first plurality of foam sheets positioned adjacent the first plurality of form panels, the first plurality of foam sheets defining a first concrete interface plane, the first concrete interface plane being generally parallel to the first and second wall planes, the first plurality of foam sheets being secured to the first plurality of form panels by at least one of the screws, wherein the first plurality of foam sheets includes individual foam sheets assembled together, each of the individual foam sheets includes interlocking elements extending from top and bottom surfaces to facilitate assembly of the individual foam sheets into the first plurality of foam sheets, the interlocking elements comprised of a plurality of fingers, the first plurality of form panels, second plurality of form panels and first plurality of foam sheets being secured to each other by a plurality of ties, the first concrete interface plane and the second wall plane at least partially defining a wall cavity.

2. The assembly of claim 1 wherein the web material is wood.

3. The assembly of claim 1 wherein the ties are selected from the group consisting of flat ties and loop ties.

4. The assembly of claim 1 wherein the screws are comprised of two inch (2") sheet rock screws.

5. The assembly of claim 1 further comprising:

spacer ties incorporated into the first plurality of foam sheets, the spacer ties located at a first wall plane defined by the first plurality of foam sheets, the first wall plane generally parallel to and spaced from the first concrete interface plane.

6. The assembly of claim 1 wherein the first and second plurality of form panels and the first plurality of foam sheets define a bottom plane and a top plane, the bottom plane and the top plane further at least partially defining the wall cavity.

7. The assembly of claim 6 wherein the wall cavity is capable of receiving uncured concrete therein, the first and second plurality of form panels and first plurality of foam sheets capable of at least partially holding the uncured concrete within the wall cavity such that the uncured concrete is able to cure into a concrete wall.

8. The assembly of claim 1 wherein the plurality of ties are breakable one of at and near the first concrete interface planes.

9. The assembly of claim 1 wherein the individual foam sheets are assembled into the first plurality of foam sheets such that their width is greater than their height.

10. The assembly of claim 5 wherein the spacer ties are integrated into the first plurality of foam sheets.

* * * * *